United States Patent [19]

Feldmann et al.

[11] Patent Number: 4,955,221

[45] **Date of Patent: * Sep. 11, 1990**

[54] ROLLING MILL FOR MAKING A ROLLED PRODUCT, ESPECIALLY ROLLED STRIP

[75] Inventors: Hugo Feldmann, Alsdorf-Warden; Tilmann Schultes, Solingen; Gerd Beisemann, Düsseldorf, all of Fed. Rep. of Germany

[73] Assignee: SMS Schloemann-Siemag Aktiengesellschaft, Düsseldorf, Fed. Rep. of Germany

[ * ] Notice: The portion of the term of this patent subsequent to Jan. 31, 2006 has been disclaimed.

[21] Appl. No.: 266,094

[22] Filed: Nov. 2, 1988

Related U.S. Application Data

[63] Continuation-in-part of Ser. No. 62,740, Jun. 15, 1987, Pat. No. 4,800,742.

[30] Foreign Application Priority Data

Jun. 16, 1986 [DE] Fed. Rep. of Germany ..... 3620197

[51] Int. Cl.[5] ..... B21B 27/02; B21B 31/18; B21B 29/00

[52] U.S. Cl. ..... 72/247; 72/199; 72/243.6; 29/122

[58] Field of Search ..... 72/247, 245, 243, 241, 72/242, 199; 29/122

[56] References Cited

U.S. PATENT DOCUMENTS

| | | | |
|---|---|---|---|
| 2,776,586 | 1/1957 | Sendzimar | 72/242 |
| 4,440,012 | 4/1984 | Feldmann et al. | 72/247 |
| 4,519,233 | 5/1985 | Feldmann et al. | 72/247 |
| 4,656,859 | 4/1987 | Ginzburg | 72/247 |

FOREIGN PATENT DOCUMENTS

| | | | |
|---|---|---|---|
| 153849 | 9/1985 | European Pat. Off. . | |
| 91540 | 1/1986 | Fed. Rep. of Germany . | |
| 131002 | 10/1981 | Japan | 72/247 |
| 173001 | 10/1983 | Japan | 72/247 |

*Primary Examiner*—Daniel C. Crane
*Attorney, Agent, or Firm*—Herbert Dubno

[57] ABSTRACT

During operation of a rolling mill the roll gap and roll shape change, because of the influence of heat, bending of the working rolls or the roll mounting, wear and the like, and must be compensated and/or balanced to make a planar product, particularly a planar rolled sheet or strip. To compensate for these undesirable disadvantageous influences on the operation of the rolling mill frequent axial sliding of the rolls with respect to each other and/or positioning of the working rolls transverse to the plane of the rolled material is required. According to our invention these undesirable influences are prevented in a particularly simple way and/or are compensated when the contours of the rolls in the initial state and/or unloaded state of the rolling mill are such that the sum of the roll body diameters at each relative axial position of the rolls varies axially from a constant value.

19 Claims, 7 Drawing Sheets

ROLLING MILL FOR MAKING A ROLLED PRODUCT, ESPECIALLY ROLLED STRIP

CROSS REFERENCE TO RELATED APPLICATION

This application is a continuation-in-part of our copending application Ser. No. 07/062,740 filed 15 June 1987, now U.S. Pat. No. 4,800,742 issued Jan. 31, 1989.

FIELD OF THE INVENTION

Our present invention relates to a rolling mill for making a rolled product, especially a rolled strip.

BACKGROUND OF THE INVENTION

A rolling mill stand generally comprises a plurality of working rolls which, if necessary, are braced by backup rolls or a combination of backup rolls and intermediate rolls.

The working rolls and/or the supporting rolls and/or the intermediate rolls can be axially shiftable relatively in the rolling mill and are provided with a substantially curved shape over their entire body length. At least two such rolls are relatively shiftable axially to adjust the gap width or shape.

The type of rolling mill is described in European Patent No. 0 091 540 in which the curved contours of the rolls is also described.

A typical roll of this type consists of a convex portion and a concave portion and the body contours of the cooperating commonly supported rolls in a definite axial relative position relative to each other attained by axially sliding the rolls complement each other.

Thus not only the uniformity of the pressing force distribution over the contact length of two adjacent rolls is improved, but also the continuous mechanical control of the form of the roll gap is improved.

OBJECTS OF THE INVENTION

It is an object of our invention to provide a further improvement in such rolling mill.

It is also an object of our invention to provide an improved rolling mill which is of a simpler structure.

It is another object of our invention to provide an improved rolling mill, particularly in regard to the form and maintenance of a definite press roll gap.

It is an additional object of our invention to provide an improved rolling mill, particularly having a more uniform pressing force distribution over the contact length of the rolls.

Yet another object of our invention is to extend further the principles discussed in the aforementioned copending application.

SUMMARY OF THE INVENTION

These objects and others which will become more readily apparent hereinafter are attained in accordance with our invention in a rolling mill comprising a plurality of working rolls which, if necessary, are supported on backup rolls or on backup rolls and intermediate rolls.

The working rolls and/or the backup rolls and/or the intermediate rolls are positioned so as to be axially slidable in the rolling mill and are provided with a substantially curved shape over their entire body length. This means that at least two of the aforementioned rolls forming the stand are shiftable relatively axially.

According to our invention the contours of the rolls in the initial state or the unloaded state are such that the axial pattern of the sum of the roll body diameters for all relatively shifted axial positions of the axially shiftable rolls with respect to each other differs from a constant value of the pattern, i.e. where the constant value of the axial position would correspond to a variation of the sum of the diameters linearly with axial position or zero variation along the length of the rolls, the deviation of the invention means that the sum of the diameters in planes perpendicular to the axes varies nonlinearly along the length of the rolls.

When the structure of the rolling mill conforms to this pattern according to our invention very advantageously all undesirable influences occurring in operation such as heat, roll bending, flattening, wear or the like already are taken into account even in the unloaded state so that they can be compensated in operation of the rolling mill.

To balance these influences in operation of the rolling mill only a slight additional axial shift of an individual roll or roll pair with respect to each other is required if at all.

With the roll contours formed according to our invention, the roll contours which do not entirely complement each other in the initial state, but can nearly completely complement each other in the loaded state, i.e. during operation of the rolling mill, especially in the vicinity of the sheet width. Also an optimum pressing force distribution is attained over the entire contact length of the rolls while maintaining at the same time a predetermined roll gap.

In principle, therefore, the rolling mill of the invention can comprise a rolling mill for rolling flat stock comprising a plurality of rolls including a pair of working rolls defining a rolling gap between them, at least one of the rolls being axially shiftable relative to another of the rolls to control the shape of the gap and having a roll body which is continuously curved over an entire length thereof, all of the rolls having roll bodies rotatable about respective axes and the roll bodies having diameters in common planes perpendicular to the axes forming respective sums, the shapes of the roll bodies being such that the sums as determined axially along the roll bodies deviate from a constant value in all relative axial positions of the bodies in accordance with a nonlinear mathematical function different from zero.

More specifically, the mathematical function is symmetrical with respect to the centers of the bodies in which one of the bodies is unshifted axially from a central position thereof.

In other works only a single roll body need be a bottle-shaped roll body in the rolling mills of the invention in spite of the fact that the rolling mills which utilize the principles of the invention can be of any standard type with respect to the arrangement of the rolls, including two-high mills, four-high mills, five-roll mills, six-high mills and the like. The summation applies not only to the working rolls and any backup or intermediate rolls lying in a common vertical plane with the working rolls, but also to any rolls outside this plane which brace the working rolls or the backup or intermediate rolls. Thus pairs of rolls can be braced against a single working roll or a single backup roll as will be apparent hereinafter.

Each "sum" of the diameters for each axial position along the mill is the sum of the diameters in a common vertical plane perpendicular to the roll axes and, when the axial shiftable roll body is shifted, in each axial position the mathematical function continues to apply across the width of the rolling.

In an advantageous example of our invention the above mentioned sum of the roll body diameters varies axially according to a mathematical function, particularly a polynomial of the nth degree, an exponential function or a trigonometric or harmonic function so that it can be easily computed each time. This polynomial function can be represented by the following equation:

$$D(z) = \sum_{i=0}^{n} a_i z^i$$

As is known the equation for a polynomial of the second degree is:

$$D(z)=a\,z^2+b\,z+c$$

The trigonometric or harmonic function can be represented as follows:

$$D(z) = \sum_{i=0}^{n} (a_i \cos(2\,\pi\,iz) + b_i \sin(2\,\pi\,iz))$$

A particular simplification of the formula for the trigonometric function is as follows:

$$D(z)=a\cos(2\pi z)+c$$

The exponential function is as shown below:

$$D(z) = \sum_{i=0}^{n} a_i \exp(b_i z)$$

A particular simplification of the exponential function is as follows:

$D(z)=a\exp(z)+A\exp(-z)$ which can be written:

$$D(z)=a\,e^{+z}+ae^{-z}$$

where D is the sum of the roll body diameters, z gives the related local coordinate (i.e. displacement at parallel to the roll axes), n indicates the number of rolls and a,b,c are constants.

In an additional example of our invention the sum of the roll body diameters varies axially piecewise according to each of a plurality of different mathematical functions. For example the sum of the roll body diameter can follow a parabolic course in a first piece or section while it can follow a sine course in a second piece or section and a parabolic course in a third course or section as in the first section.

According to our invention further the above mentioned sum of the roll body diameters can be a sum, weighted mean or a linear combination of several mathematical functions The course or pattern of the contour can correspond, for example, to the equation:

$$D(z)=a\,z^2+b\cos(2\pi z)+c.$$

Also the sum of the roll body diameters can vary axially according to a function which is symmetric about the center of the rolls in each relative axial position of the rolls. Likewise according to our invention the sum of the roll body diameters can vary according to a function which is unsymmetrical about the center of the rolls in each relative axial position of the rolls.

According to an additional advantageous form of our invention the contour of the rolls, particularly the working rolls, is composed of a gently convex and a strongly concave curved portion and varies according to a function which is combined from an exponential function and a polynomial function. This roll contour is particularly well suited for compensation of the effects of strongly different temperature conditions and/or temperature changes on the rolls and the roll gap.

According to another advantageous example of our invention the pressing force rolls are axially slidable only on one side of a plane lying in the rolled material or product. In this way a press roll gap overlapping the profile height is avoided and a particularly uniform distribution of the load or stresses is attained over the contact length of the working rolls.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
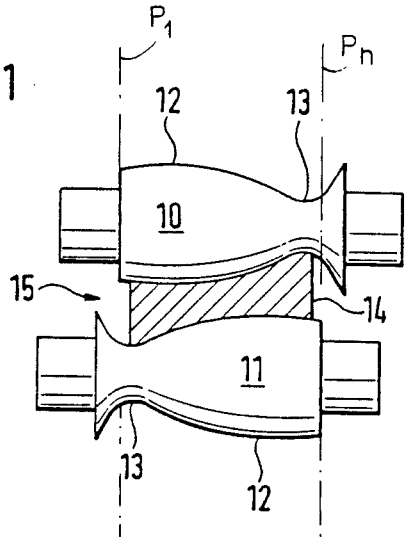
FIG. 1 is a schematic cross sectional view of a working roll pair in the rolling mill of our invention with gently convex and strongly concave contoured portions and with the rolls in axial positions having convex portions opposite each other.

Two working rolls 10 and 11 of a rolling mill are shown in FIG. 1 whose contours are each composed of a gently convex portion 12 and a strongly concave portion 13. The shape of these contours is constructed from a polynomial function (convex portion 12) and an exponential function (concave portion 13).

In FIG. 1 the upper working roll 10 is shifted axially to the right a definite amount (+100 mm) from the centered position opposite to the lower working roll 11. In this position the working rolls 10,11 correspond to a conventional convexly bulged pair of rolls with parabola like convexity and the rolled sheet or strip 14 has a biconcave form corresponding to this roll gap 15.

In FIG. 1, a plane $P_1$ is shown at one end and a plane $P_n$ is shown at the opposite end, each diameter sum being measured in a respective plane $P_1 \ldots P_n$.

Figure 2:
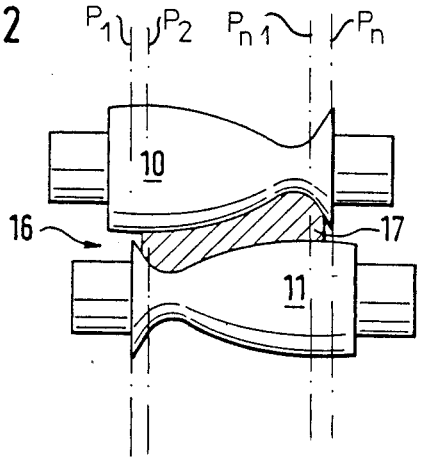
FIG. 2 is a schematic cross sectional view of the working roll pair shown in FIG. 1 with the rolls pushed from the axial positions opposite each other.

In the example shown in FIG. 2 the upper working roll 10 is shifted axially to the left from the centered position however about the same amount (−100 mm) relative to the lower working roll 11.

In FIG. 2 the planes in which the diameters are summed are represented at $P_1$, $P_2 \ldots P_{n-1}$ and $P_n$ by way of example.

Since the working rolls are identical in the examples of FIGS. 1 and 2 shown in the drawing, they were provided with the same reference characters.

In the configuration of the working rolls 10,11 shown in FIG. 2 a roll gap is formed which produces a rolled sheet or strip 17 having a substantially rectangular cross sectional shape with gently rounded outer edges located diagonally opposite each other.

By axially sliding the upper working roll 10 relative to the lower working roll 11 from the outer position (v=+100 mm) shown in FIG. 1 into the lower outer position (v=−100 mm) shown in FIG. 2, the roll gap and corresponding roll strip cross section can be adjusted from doubly concave to generally rectangular stepwise selectively very advantageously and also maintained.

It is understood that the positions of the working rolls with respect to each other shown in FIGS. 1 and 2 can also be attained by sliding the lower roll 11 with respect to the upper roll 10.

Also the working rolls 10,11 can be supported by correspondingly configured backup rolls and if necessary intermediate rolls not shown in FIGS. 1 and 2.

The essential advantage of these contoured working rolls 10,11 according to our invention is that they are particularly suitable for compensation of the effect of different temperature conditions. When the roll shape is determined only by the mechanically set surface contour a convexity or bulged shape is required for compensation of the elastic deformation of the roll seat as is accomplished by the position of the working rolls shown in FIG. 1. With temperature increase however a temperature distribution develops which is flat in the central region of the roll body and drops at the ends of the roll body.

The thermal distribution, because of the differences in thermal expansion has a profile corresponding to the roll shape in FIGS. 1 and 2.

The required mechanically determined convexity of the rolls is correspondingly reduced Simultaneously however a compensation or balancing of the changed roll diameters in the vicinity of the ball ends is required. Both effects may be compensated by axial sliding of the upper roll 10 seen in FIGS. 1 and 2 relative to the lower roll stepwise to the extreme position ( v=−100 mm) an amount depending on the temperature level.

Figure 3:
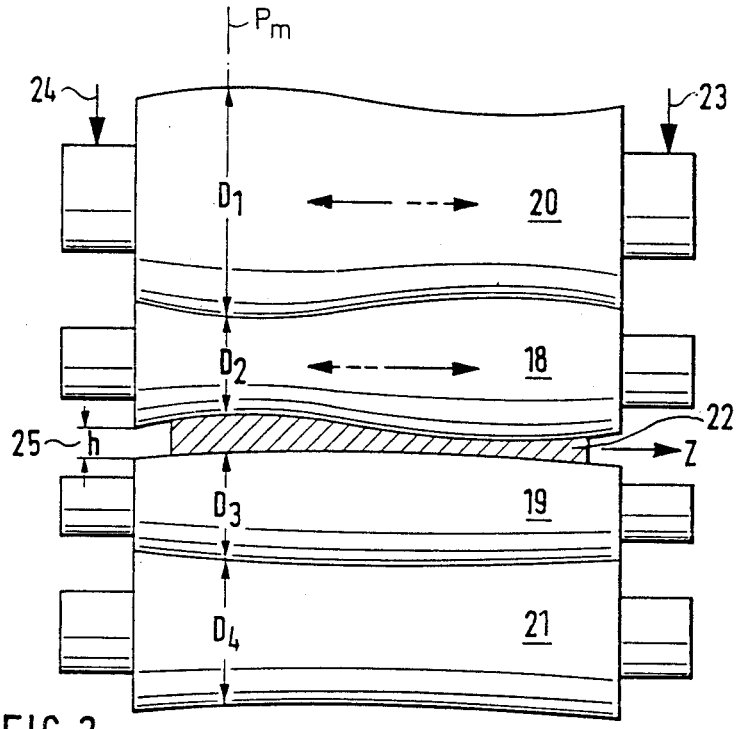
FIG. 3 is a schematic cross sectional view of a four-high rolling mill with contoured rolls slidable axially positioned above the plane of the rolled sheet or strip.

FIG. 3 shows a rolling mill with two working rolls 18, 19 and two backup rolls 20, 21. The plane in which the diameters are represented in FIG. 3 is the plane $P_m$. The rolls 18, 20 above the plane of the strip 22 to be rolled are shaped approximately bottle shaped and are axially slidable with respect to one another and the rolls below the plane of the roll sheet or strip 22. The working rolls 18,19 and the backup rolls 20,21 are disposed vertically one below the other as seen in the direction of the arrows 23, 24 and are thus coplanar.

The shape of the roll gap (of course transverse to the roll direction) may be influenced by the shape of the roll body. An increase of the local diameter ($D_i$) of a roll reduces the height of the roll gap locally whereby the "penetration" of the individual rolls is different for example according to the formula:

$$h(z)=c_1D_1(z)+c_2D_2(z)+c_3D_3(z)+c_4D_4(z)$$

and of course with $c_1$, $c_4$=0.4 to 0.45 for the backup rolls 20, 21 and $c_2$, $c_3$=0.7 to 0.95 for the working rolls 18, 19, each according to the roll diameter, body length, elastic properties, load level, etc.

The roll shape or the contour must be so selected and/or formed that the net effect on the roll gap has the desired form symmetrical generally to the roll sheet or strip center:

$$h(z)=c_1D_1(z-v_1)+c_2D_2(z-v_2)$$

where $v_1$ and $v_2$ are the displacement of the rolls.

Usually one provides the rolls distant from the rolled product with a strengthened contour and of course approximately according to a relationship:

$$(D_{1max}-D_{1min}):(D_{2max}-D_{2min})=c_2:c_1$$

It can be significant that different amounts for the displacements $v_1$ and $v_2$ are selected (approximately $v_1>v_2$). With a suitable choice of the roll shape one of the rolls can be entirely eliminated from axial sliding.

Figure 4:
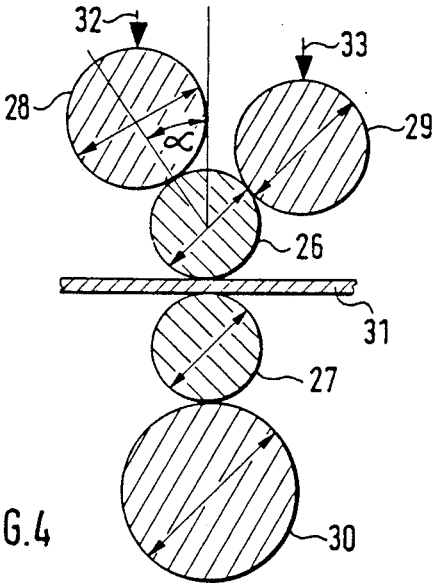
FIG. 4 is a schematic cross sectional view of a five roll rolling mill with shaped or contoured rolls axially slidable positioned above the plane of the rolled sheet or strip.

In the five roll rolling mill shown in FIG. 4 with both working rolls 26,27 and the backup rolls 28, 29 and 30 the rolls 26,28 and 29 found above the plane of the rolled sheet or strip are arranged axially slidable. However the arrangement of the upper backup rolls 28,29 is such that they, as seen in the direction of the applied force (arrows 32, 33), are positioned side by side.

Besides in the same way as in the four roll rolling mill shown in FIG. 3 the roll gap shape is influenced by all roll diameter functions. The penetration or throughput of the rolls is however reduced relative to the rolls of FIG. 3 by about the direction cosine of the applied forces. The net effect as cited above in connection with the description related to FIG. 3 is again determinative for the roll gap.

Since with the symmetric arrangement both backup rolls have the same effect on the roll gap, a symmetric control of the roll gap shape can be attained in contrast to the rolling mill of FIG. 3 with the same roll shape.

The particular advantage of the rolling mill formed according to our invention shown in FIGS. 3 and 4 as opposed to the previously known rolling mill is that an s-shape roll gap superposition on the profile cross section is avoided and a uniform distribution of forces or loads on the working rolls, particularly over the body of the rolls, is attained.

Figure 5:
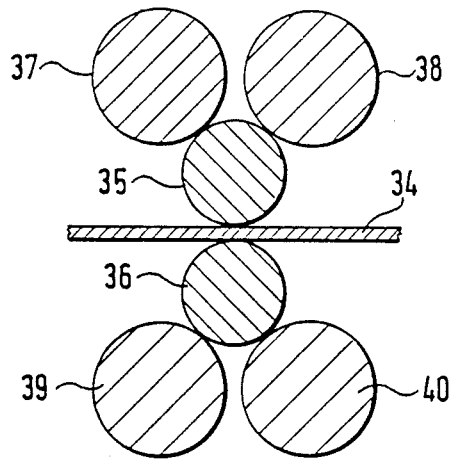
FIGS. 5 and 6 are schematic cross sectional views of a six roll rolling mill with different arrangements of the rolls above and below the plane of the rolled sheet or strip.

If necessary as shown in FIG. 5 in a rolling mill with six rolls a symmetrical arrangement of the working rolls 35, 36 and the backup rolls 37, 38 and/or 39, 40 so that the plane of the roll strip 34 is a mirror plane can be provided. Also in this rolling mill the roll shape according to our invention is such that only one axial sliding of one of the rolls, particularly a working roll, relative to the other rolls is provided on only one side of the rolling mill, i.e. on the upper or lower side of the roll sheet or strip 34.

Figure 6:
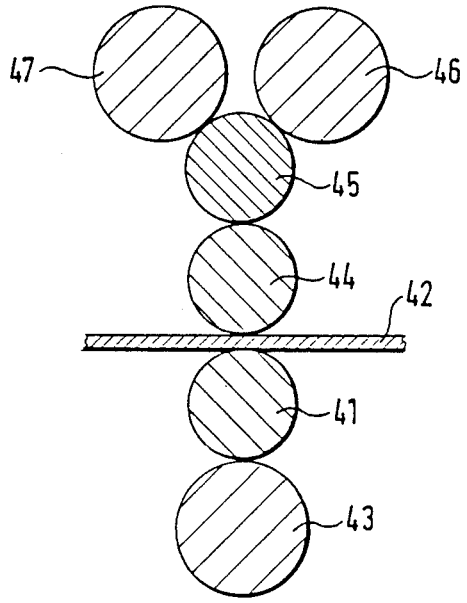

Besides as FIG. 6 shows the arrangement of the rolls in a rolling mill with six rolls can be provided very advantageously so that the working roll 41 below the roll sheet or strip 42 is supported only by one supporting roll 43 while the support of the working roll 44 found above the roll sheet or strip 42 occurs by an intermediate roll 45 and two backup rolls 46, 47 cooperating with the intermediate roll 45.

Figure 7:
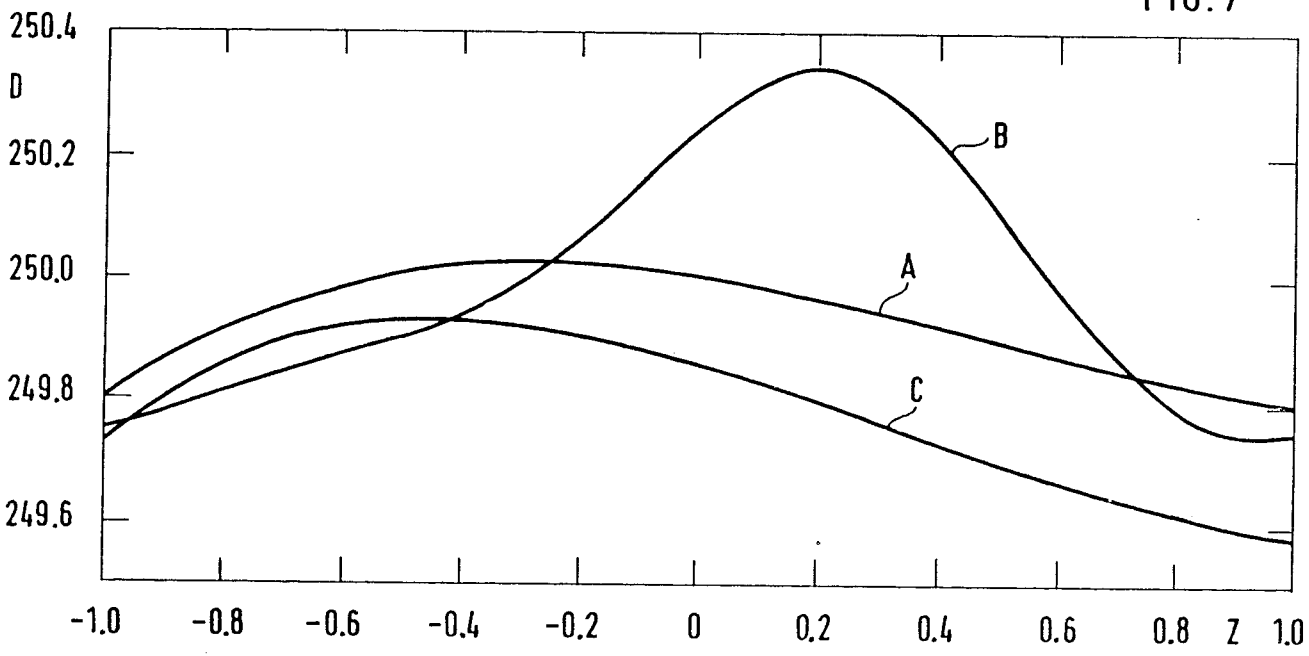
FIG. 7 is a graphical illustration of different shapes of individual rolls computed according to a relationship for the sum of the roll body diameters for two working rolls.

Different shapes of the rolls are shown in FIG. 7 in which the roll body diameter (D,mm) is shown as a function of the related distance along the roll body, Z (the horizontal axis). For two opposing equal symmetric upper and lower rolls the shape for an individual roll designated with A accordingly can be represented with a third degree polynomial and is given by the following formula:

$$D_1(z)=250-0.15\,z-0.20\,z^2+0.15\,z^3$$

In the case of curve B the shape for the individual roll follows that of an angular function and is given by:

$$D_1(z)=250+0.25\cos(\pi z)+0.10\sin(\pi z)+0.08\sin(2\pi z)$$

For the curve C the functional form involves that of an exponential:

$$D_1(z)=250-0.35\exp(z)-0.12\exp(-2z)+0.27\exp(-z)+0.06\exp(2z) \text{ or}$$

$$D_1(z)=250-0.35e^{z}-0.12e^{-2z} \text{ to } 0.27e^{-z}+0.06e^{+2z}$$

Figure 8:
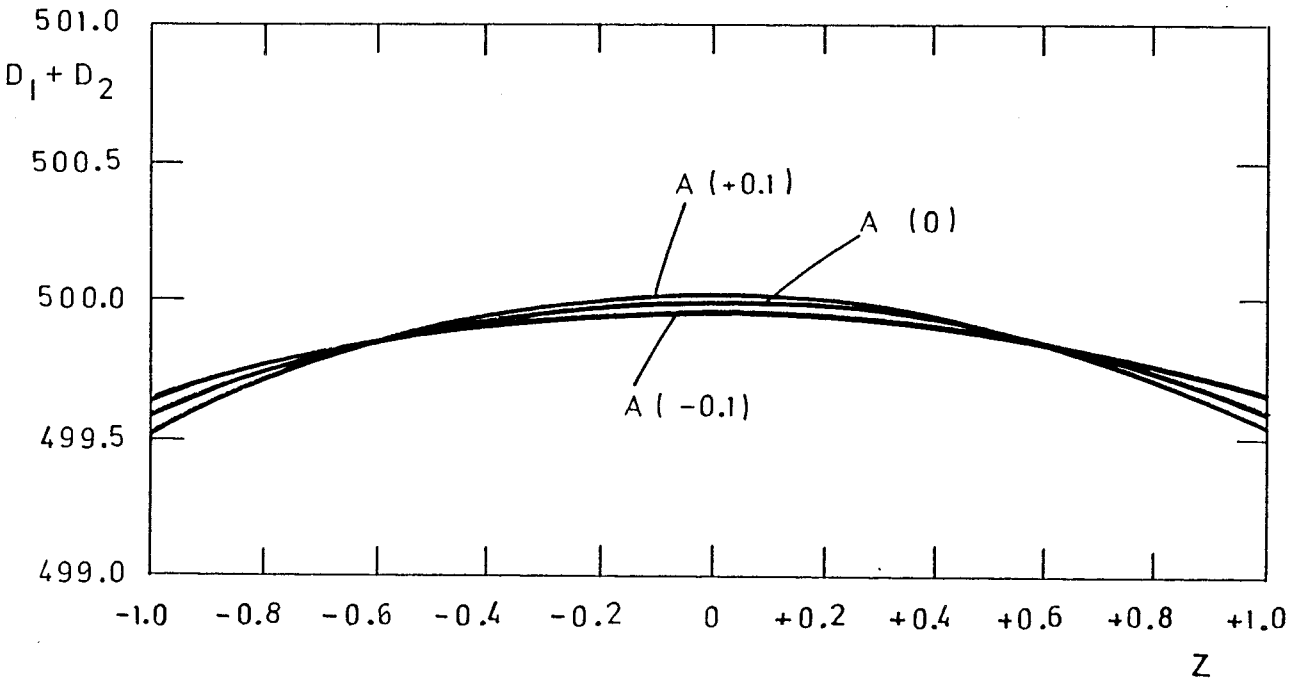
FIGS. 8–10 are graphical representations of sums of the roll diameters ($D_1+D_2$) plotted along the ordinates vs. axial location Z plotted along the abscissas.
Figure 9:
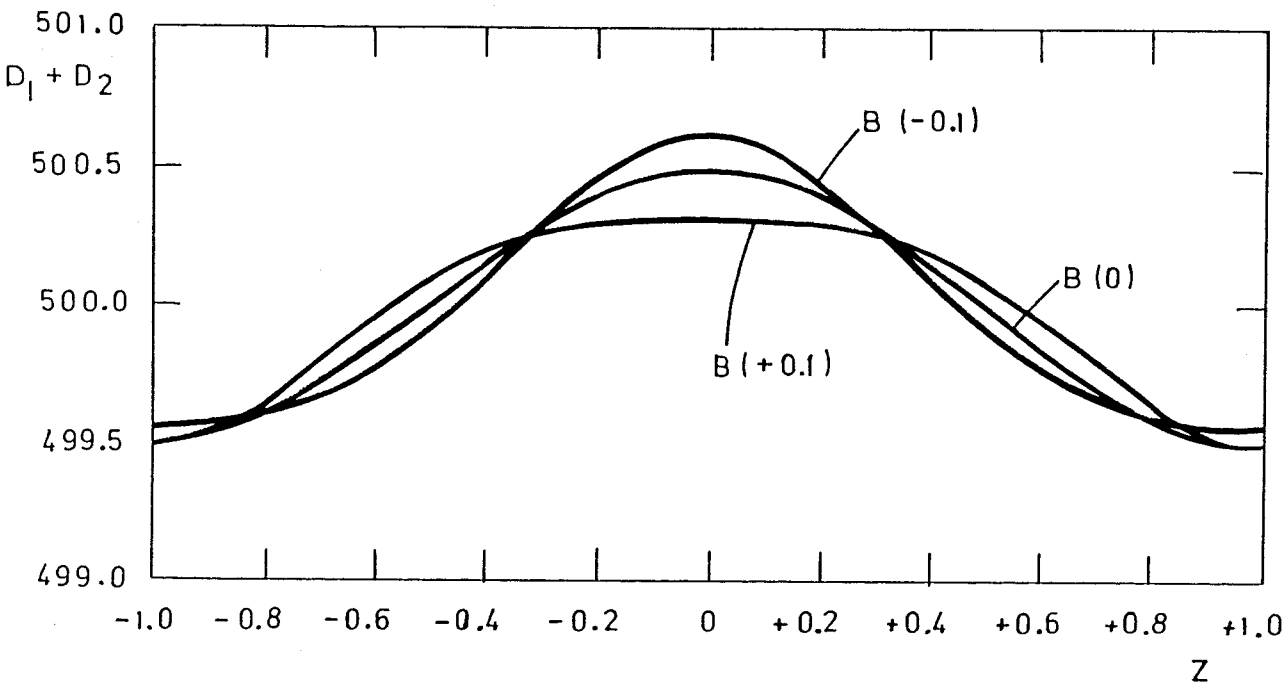

FIG. 8 shows the axial variation of the sum $(D_1+D_2)$ of the roll diameters in a two-high mill using rolls with the profile corresponding to that of the curve A of FIG. 7 while FIGS. 8 and 9 are corresponding views of the variation with rolls respectively corresponding to those of curves B and C of FIG. 7.

Figure 10:
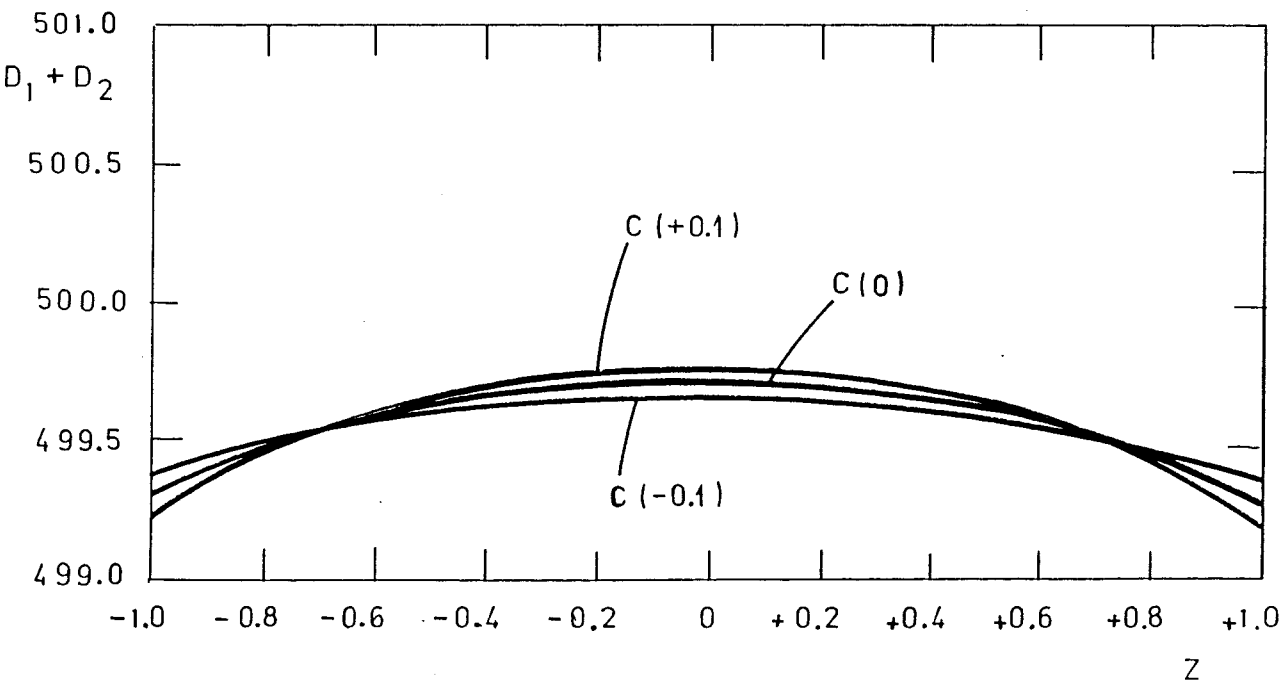

The middle curves in FIGS. 8–10 represent the axial variation of the respective sum $(D_1+D_2)$ without relative axial shifting of the two rolls, while the curve designated at (+0.1) represents the axial variation of the sum with a shift to the right of 0.1 unit from the central position and the curve (−0.1) represents a shift of 0.1 unit to the left.

Furthermore many other variations are possible, especially in regard to the arrangement of several backup rolls and intermediate rolls on one or both sides of the roll gap, and of course with the same advantages as were described in connection with the rolling mills shown in the drawing.

That is also true in regard to arbitrary arrangements with the four high rolling mill.

Also it is possible to arrange the working rolls of the rolling mill according to our invention so that they are pivotable toward each other in the roll plane or to arrange the axes of the cooperating roll pairs adjustably inclinable toward each other transverse to the roll plane. However it is essential that the rolls in the rolling mill according to our invention be shaped or contoured so that, when two-bottle-shaped rolls are provided, these rolls are complementary to one another in the loaded state but are not complementary in the unloaded state.

We claim:

1. A rolling mill for rolling flat stock comprising a plurality of rolls including a pair of working rolls defining a rolling gap between them, at least one of said rolls being axially shiftable relative to another of said rolls to control the shape of said gap and having a roll body which is continuously curved over an entire length thereof, all of said rolls having roll bodies rotatable about respective axes and said roll bodies having diameters in common planes perpendicular to said axes forming respective sums, the shapes of said roll bodies being such that said sums as determined axially along said roll bodies deviate from a constant value in all relative axial positions of said bodies in accordance with a nonlinear mathematical function different from zero.

2. The rolling mill defined in claim 1 wherein said mathematical function is symmetrical with respect to the centers of said bodies in which said one of said bodies is unshifted axially from a central position thereof.

3. The rolling mill defined in claim 2 wherein said mathematical function corresponds to a $n^{th}$ degree polynomial, where n is an integer.

4. The rolling mill defined in claim 2 wherein said mathematical function has an exponential function.

5. The rolling mill defined in claim 2 wherein said mathematical function is a harmonic function.

6. The rolling mill defined in claim 2 wherein said mathematical function is constituted of segments of different functions selected from $n^{th}$ degree polynomial functions where n is an integer, exponential functions and harmonic functions.

7. The rolling mill defined in claim 2 wherein said mathematical function is a sum of different functions selected from $n^{th}$ degree polynomial functions where n is an integer, exponential functions and harmonic functions.

8. The rolling mill defined in claim 2 wherein said mathematical function has a weighted means of different functions selected from $n^{th}$ degree polynomial functions where n is an integer, exponential functions and harmonic functions.

9. The rolling mill defined in claim 2 wherein said mathematical function has a linear combination of different functions selected from $n^{th}$ degree polynomial functions where N is an integer, exponential functions and harmonic functions.

10. The rolling mill defined in claim 1 wherein said one of said rolls is a bottle-shaped roll.

11. The rolling mill defined in claim 10 wherein said bottle-shaped roll is a backup roll braced against a working roll.

12. The rolling mill defined in claim 10 wherein said rolls form a two-high rolling mill.

13. The rolling mill defined in claim 10 wherein said rolls form a four-high rolling mill.

14. The rolling mill defined in claim 13 wherein two of said rolls are bottle-shaped rolls and are relatively displaceable axially in contact with one another.

15. The rolling mill defined in claim 10 wherein said rolls include a pair of rolls braced against another roll on at least one side of said gap.

16. The rolling mill defined in claim 15 wherein a single backup roll is braced against a working roll on the opposite side of said gap.

17. The rolling mill defined in claim 15 wherein a pair of rolls is braced against each working roll on each side of said gap.

18. The rolling mill defined in claim 15 wherein a pair of rolls is braced against a backup roll which is braced, in turn, against a working roll on at least said one side of said gap.

19. The rolling mill defined in claim 1 wherein one of said rolls is a backup roll for one of said working rolls.

* * * * *